US011235483B2

(12) United States Patent
Hahn et al.

(10) Patent No.: US 11,235,483 B2
(45) Date of Patent: Feb. 1, 2022

(54) TRIMMER RAZOR

(71) Applicant: Leaf Shave Company, Pittsburgh, PA (US)

(72) Inventors: Adam J. Hahn, Pittsburgh, PA (US); Adam Simone, Pittsburgh, PA (US)

(73) Assignee: Leaf Shave Company, Pittsburgh, PA (US)

( * ) Notice: Subject to any disclaimer, the term of this patent is extended or adjusted under 35 U.S.C. 154(b) by 0 days.

(21) Appl. No.: 16/486,661

(22) PCT Filed: Feb. 16, 2018

(86) PCT No.: PCT/US2018/018469
§ 371 (c)(1),
(2) Date: Aug. 16, 2019

(87) PCT Pub. No.: WO2018/152387
PCT Pub. Date: Aug. 23, 2018

(65) Prior Publication Data

US 2020/0269453 A1 Aug. 27, 2020

Related U.S. Application Data

(60) Provisional application No. 62/460,438, filed on Feb. 17, 2017.

(51) Int. Cl.
*B26B 21/16* (2006.01)
*B26B 21/40* (2006.01)

(52) U.S. Cl.
CPC ..... *B26B 21/16* (2013.01); *B26B 21/4012* (2013.01)

(58) Field of Classification Search
CPC ..... B26B 21/14; B26B 21/16; B26B 21/18; B26B 21/4012; B26B 21/4075; B26B 21/4068; B26B 21/52; B26B 21/521
USPC ..... 30/346.61, 84, 72, 73, 75
See application file for complete search history.

(56) References Cited

U.S. PATENT DOCUMENTS

| | | | |
|---|---|---|---|
| 956,532 | A | 5/1910 | Kieselhorst |
| 1,060,657 | A | 5/1913 | Alter |
| 1,159,487 | A | 11/1915 | Fuller |
| 1,205,187 | A | 11/1916 | Fuller |
| 1,206,315 | A | 11/1916 | Ehrlich |
| 1,220,837 | A | 3/1917 | Fuller |

(Continued)

FOREIGN PATENT DOCUMENTS

| | | | |
|---|---|---|---|
| EP | 0969951 | B1 | 5/2002 |
| GB | 171304 | A | 11/1921 |

OTHER PUBLICATIONS

Onthehouse, Righty-Tighty and Lefty-Loosey, Jul. 28, 2014, retrieved from https://www.onthehouse.com/right-tighty-lefty-loosey/ (Year: 2014).*

(Continued)

*Primary Examiner* — Evan H MacFarlane
(74) *Attorney, Agent, or Firm* — The Webb Law Firm

(57) ABSTRACT

A trimmer razor including a handle, a head operatively connected to the handle, the head including a base member, a seat extending from the base member, and a cover connected to the seat, and an extension arrangement connecting the cover to the handle so that, upon rotation of the handle. The cover is movable between an open position and a closed position.

14 Claims, 19 Drawing Sheets

(56) References Cited

U.S. PATENT DOCUMENTS 1,367,158 A 2/1921 McAuliffe
1,411,287 A * 4/1922 McAuliffe ..... B26B 21/50 30/35
1,482,371 A 1/1924 Witter
1,492,246 A 4/1924 Gaisman
1,494,998 A * 5/1924 Crough ..... B26B 21/18 30/50
1,497,030 A 6/1924 Salemi
1,497,153 A * 6/1924 Moulton ..... B26B 21/18 30/74
1,522,716 A 1/1925 Frank
1,550,861 A 8/1925 Wolcott
1,552,234 A 9/1925 Roebuck
1,581,469 A 4/1926 Oskin
1,582,707 A * 4/1926 Trevor ..... B26B 21/20 30/41.7
1,598,189 A 8/1926 Addison
1,633,139 A 6/1927 Staats-Oels
1,635,827 A 7/1927 Frank
1,694,337 A 12/1928 Oberheim
1,710,548 A 4/1929 Minahan
1,719,675 A 7/1929 Sirch
1,734,524 A 11/1929 Kohlmiller
1,735,751 A 11/1929 Green
1,744,752 A 1/1930 Crespo
1,771,878 A * 7/1930 De Palma ..... B26B 21/18 30/41
1,805,895 A 5/1931 Watson
1,807,342 A 5/1931 Pelosi
1,816,404 A 7/1931 Schwarz
1,826,410 A 10/1931 Aronson
1,853,839 A 4/1932 Wolcott
1,859,555 A 5/1932 De Haven
1,871,010 A * 8/1932 Robb ..... B26B 21/18 30/41
1,871,789 A 8/1932 Green
1,887,911 A 11/1932 Aronson
1,901,591 A 3/1933 Godshalk
1,905,331 A 4/1933 Aronson
1,907,783 A 5/1933 Gaisman
1,911,996 A * 5/1933 Gaisman ..... B26B 21/18 30/75
1,914,630 A 6/1933 Aronson
1,920,711 A 8/1933 Pelizzola
1,929,463 A 10/1933 Wolcott
1,932,386 A 10/1933 Aronson
1,938,481 A * 12/1933 Black ..... B26B 21/18 30/41
1,952,253 A 3/1934 Hoff
1,954,259 A 4/1934 Norviel
1,959,841 A 5/1934 Sage
1,965,348 A 7/1934 Lucia
1,966,425 A 7/1934 Aronson
1,966,426 A 7/1934 Aronson
1,975,757 A * 10/1934 Gray ..... B26B 21/18 30/50
1,978,988 A 10/1934 Cook et al.
1,998,200 A 4/1935 McDowell
2,001,155 A 5/1935 Peters
2,002,682 A * 5/1935 Wyman ..... B26B 21/50 30/36
2,026,125 A 12/1935 Godshalk et al.
2,048,868 A 7/1936 Johnston
2,062,683 A 12/1936 Smith
2,090,968 A 8/1937 Testi
2,103,924 A 12/1937 Young
2,113,772 A 4/1938 Rothschild et al.
2,121,000 A 6/1938 Anderson
2,125,135 A 7/1938 Trippe
2,127,717 A 8/1938 Bryant
2,252,499 A 8/1941 Flaws, Jr.
2,252,569 A 8/1941 Kennison
2,290,964 A 7/1942 Hill
2,319,488 A 5/1943 Burchett
2,397,555 A 4/1946 Lotthamer
2,429,334 A 10/1947 Smith
2,458,257 A 1/1949 Donovan
2,502,062 A 3/1950 Rieger
2,565,281 A 8/1951 Thomas
2,581,214 A 1/1952 Stegner
2,602,220 A 7/1952 Ewing
2,602,221 A 7/1952 Ewing et al.
2,640,258 A 6/1953 Eckert
2,666,982 A 1/1954 Schroder
2,769,232 A 11/1956 Leonard, Sr.
2,780,866 A 2/1957 Borden
2,787,921 A 4/1957 Blankenship
2,839,829 A 6/1958 Knapp
2,911,712 A 11/1959 Choclin et al.
3,057,062 A 10/1962 Mashiba
3,080,651 A 3/1963 La Cas
3,101,536 A 8/1963 Bringewald
3,167,888 A 2/1965 Shanley
3,199,252 A 8/1965 Hanchey
3,383,764 A 5/1968 Sachs
3,491,442 A 1/1970 Kuhnl
3,653,123 A 4/1972 King et al.
3,708,879 A 1/1973 Stephenson et al.
3,909,942 A 10/1975 Ciaffone
3,950,849 A 4/1976 Perry
3,964,159 A 6/1976 Ferraro
4,189,832 A 2/1980 Harper et al.
4,245,388 A 1/1981 Dawidowicz et al.
4,265,055 A 5/1981 Cartwright et al.
4,345,374 A 8/1982 Jacobson
4,485,554 A 12/1984 Bergamaschi
4,608,782 A 9/1986 Chylinski
4,715,120 A 12/1987 McGready
4,807,401 A 2/1989 Atwater
4,860,449 A 8/1989 Duncan
5,036,731 A 8/1991 Fletcher
5,074,042 A 12/1991 Althaus et al.
5,139,138 A 8/1992 Isaksen
5,253,420 A 10/1993 Althaus et al.
5,522,137 A 6/1996 Andrews
5,848,475 A 12/1998 Hill et al.
6,385,850 B1 5/2002 Coulthard, Jr.
6,449,849 B1 9/2002 Hackerman
6,565,586 B2 * 5/2003 Harrold ..... A61F 9/0133 606/166
6,694,618 B1 2/2004 de Villiers
7,104,874 B1 9/2006 Gussack et al.
8,074,535 B2 12/2011 Martell
2009/0000426 A1 1/2009 Andersen et al.
2010/0139103 A1 6/2010 Miyazaki
2010/0223792 A1 9/2010 Martell
2012/0317820 A1 12/2012 McGushion et al.
2013/0237134 A1 9/2013 Worthington
2014/0190014 A1 7/2014 Hahn
2015/0360375 A1 12/2015 Wertz
2016/0075040 A1 3/2016 Nordstrom
2017/0297212 A1 * 10/2017 Nordstrom ..... B26B 21/521

OTHER PUBLICATIONS

The Beluga Razor: A Barber Quality Shave . . . Minus the Barber; Beluga Shave Co., https:www/kickstarter.com/projects/257125380/the-beluga-razor-a-barber-quality-shaveminus-the-b?ref=nav_search, 22 pages, Oct. 14, 2014.

* cited by examiner

TRIMMER RAZOR

CROSS-REFERENCE TO RELATED APPLICATIONS

This application is the United States national phase of International Application No. PCT/US2018/018469 filed Feb. 16, 2018, and claims the benefit of U.S. Provisional Patent Application No. 62/460,438 filed Feb. 17, 2017, the disclosures of which are hereby incorporated by reference in their entirety.

BACKGROUND OF THE INVENTION

Field of the Invention

This disclosure relates generally to razors and, more particularly, to a trimmer razor with replaceable blades.

Description of Related Art

Razors have become ubiquitous and are used by both men and women for their personal shaving needs. Straight-blade razors, which are made of high carbon or stainless steel, exemplify the early modern popular style of shaving implements. These razors can be used for many shaving sessions over a longer period of time, but must be maintained by regular sharpening or stropping. The process of sharpening, or honing, the blade uses an abrasive material that removes material from the blade's edge. Stropping, which must be done with each use of a straight-blade razor, straightens and re-aligns the blade, which tends to bend and pit under use preventing a close shave if not straightened.

Double-edged safety razors replaced the straight edge in popularity in the early part of the twentieth century. The disposal of blades after limited use was made popular and economical by the arrival of blades made of low-cost, thin steel, thereby eliminating the need for stropping or honing. The safety feature of these razors, protecting the user from all but the very edge of the blade, appealed to the user. The orientation of the handle and the blade required the user to develop the proper technique to achieve an optimal shave. The next evolution combined the safety of small, thin blades exposed only at the edge with the proper angle-of-attack and a pivoting head to adjust to the contours of the body. The disposable razor embodied the ease and simplicity of shaving, sacrificing longevity of product by providing disposable blades with limited life. This incarnation of men's and women's personal shavers remains the most popular and widely used, contributing a sizeable negative global economic impact.

While the convenience and ease of use of current disposable razor technology is attractive to users, alternative razors using double-edged blades have continued to evolve. Many of the current safety razors use one double-edged blade and clamp the blade to the head of the safety razor to hold it rigidly in place. Typically, one blade edge is exposed on each side of the razor head. Many of these safety razors, however, do not include a pivoting head, thereby requiring a user to hold the razor and blade at a specific angle to his/her face to receive a proper shave. This can lead to a tedious process that does not always provide the close shave that one desires.

Trimmer razors have recently been incorporated into cartridge razors to aid in reaching hard-to-reach areas of the body, such as under the nose, where larger multiple blade cartridges cannot reach due to their larger size and/or additional features included on the cartridge such as lubricating strips. These trimmer razors have minimal material surrounding the blade that could block the blade from being positioned in a correct position to shave the user's hair. In addition to providing increased utility, trimmer razors also assist in producing precise hair lines, such as sideburns and beards, due to an increase in visualization for the user of where the blade will actually land on the skin surface. In multiple blade cartridges, the surrounding cartridge material can be bulky and prohibit an accurate sense of where the blades will actually cut the hair, making a precise shave difficult to achieve.

Current trimmer razors are currently incorporated into expensive disposable cartridge razors. During a typical shave, the trimmer razor only cuts a fraction of the hair that the remaining blades cut, since the remaining blades cut the hair on the majority of the area to be shaved. These main blades wear out much more quickly than the trimmer razor blades. Since the main blades are connected to the trimmer blade in the cartridge, however, the trimmer blades are often disposed of at the same time as when the main blades become dull and need replaced with new blades. Disposal of the trimmer razor not only increases waste, but also increases the cost of the entire cartridge unnecessarily.

SUMMARY OF THE INVENTION

In accordance with one aspect of the disclosure, a trimmer razor includes a handle, a head operatively connected to the handle, the head including a base member, a seat extending from the base member, and a cover connected to the seat, and an extension arrangement connecting the cover to the handle so that, upon rotation of the handle, the cover is movable between an open position in which the cover is spaced from the seat and a closed position in which the cover is clamped to the seat.

In accordance with another aspect of the disclosure, the extension arrangement includes a screw member threadedly connected to the handle and the base member. The extension arrangement may also include a fastener extending through the cover into the screw member. One end of the fastener is received within a cavity defined by the screw member via a friction fit. One end of the handle defines a cavity with a threaded inner surface that receives an end of the screw member. Upon rotation of the handle in a clockwise direction, the extension arrangement moves the cover to the closed position, and, upon rotation of the handle in a counterclockwise direction, the extension arrangement moves the cover to the open position. At least one extension member extends from the cover and is received within the seat to guide movement of the cover relative to the seat. One end of the handle is received within the base member of the head. At least one magnet is provided within the seat to assist in holding a razor blade to the seat. At least one razor blade is clamped between the cover and the seat when the cover is in the closed position. The base member may define at least one aperture extending through a surface thereof. The at least one razor blade is removably provided within the head. The seat and the cover form a substantially planar shaving plane to assist in providing a repeatable shaving angle. A shaving gap is defined between a front edge of the cover and a front edge of the seat. At least one protrusion extends from the seat to assist in positioning a razor blade on the seat. The at least one protrusion includes two protrusions that constrain movement of the razor blade in two degrees of freedom on the seat.

In accordance with another aspect of the disclosure, a trimmer razor includes a handle, a head connected to the handle, the head including a seat and a cover, and at least one fastener extending through the cover and into the seat to clamp the cover to the seat. The at least one fastener includes a screw that is configured to be tightened or loosened to move the cover between a closed position and an open position.

In accordance with another aspect of the disclosure, a trimmer razor includes a handle and a head connected to the handle, the head including a seat and a cover, the cover is attachable to the seat via at least one locking tab extending from the cover. The at least one locking tab includes a locking hook configured to latch onto the seat to clamp the cover to the seat. The at least one locking tab is at least partially elastic to permit snap locking of the at least one locking tab on the seat.

Further aspects of the disclosure will now be described in the following numbered clauses.

Clause 1: A trimmer razor, comprising a handle; a head operatively connected to the handle, the head comprising a base member, a seat extending from the base member, and a cover connected to the seat; and an extension arrangement connecting the cover to the handle so that, upon rotation of the handle, the cover is movable between an open position in which the cover is spaced from the seat and a closed position in which the cover is clamped to the seat.

Clause 2: The trimmer razor as recited in Clause 1, wherein the extension arrangement comprises a screw member threadedly connected to the handle and the base member.

Clause 3: The trimmer razor as recited in Clause 2, wherein the extension arrangement further comprises a fastener extending through the cover into the screw member.

Clause 4: The trimmer razor as recited in Clause 3, wherein one end of the fastener is received within a cavity defined by the screw member via a friction fit.

Clause 5: The trimmer razor as recited in Clause 3 or Clause 4, wherein one end of the handle defines a cavity with a threaded inner surface that receives an end of the screw member.

Clause 6: The trimmer razor as recited in any of Clauses 1-5, wherein, upon rotation of the handle in a clockwise direction, the extension arrangement moves the cover to the closed position, and wherein, upon rotation of the handle in a counterclockwise direction, the extension arrangement moves the cover to the open position.

Clause 7: The trimmer razor as recited in any of Clauses 1-6, wherein at least one extension member extends from the cover and is received within the seat to guide movement of the cover relative to the seat.

Clause 8: The trimmer razor as recited in any of Clauses 1-7, wherein one end of the handle is received within the base member of the head.

Clause 9: The trimmer razor as recited in any of Clauses 1-8, further comprising at least one magnet provided within the seat to assist in holding a razor blade to the seat.

Clause 10: The trimmer razor as recited in any of Clauses 1-9, further comprising at least one razor blade clamped between the cover and the seat when the cover is in the closed position.

Clause 11: The trimmer razor as recited in Clause 10, wherein the base member defines at least one aperture extending through a surface thereof.

Clause 12: The trimmer razor as recited in Clause 10 or Clause 11, wherein the at least one razor blade is removably provided within the head.

Clause 13: The trimmer razor as recited in any of Clauses 1-12, wherein the seat and the cover form a substantially planar shaving plane to assist in providing a repeatable shaving angle.

Clause 14: The trimmer razor as recited in any of Clauses 1-13, wherein a shaving gap is defined between a front edge of the cover and a front edge of the seat.

Clause 15: The trimmer razor as recited in any of Clauses 1-14, further comprising at least one protrusion extending from the seat to assist in positioning a razor blade on the seat.

Clause 16: The trimmer razor as recited in Clause 15, wherein the at least one protrusion comprises two protrusions that constrain movement of the razor blade in two degrees of freedom on the seat.

Clause 17: A trimmer razor, comprising a handle; a head connected to the handle, the head comprising a seat and a cover; and at least one fastener extending through the cover and into the seat to clamp the cover to the seat.

Clause 18: The trimmer razor as recited in Clause 17, wherein the at least one fastener comprises a screw that is configured to be tightened or loosened to move the cover between a closed position and an open position.

Clause 19: A trimmer razor, comprising a handle; and a head connected to the handle, the head comprising a seat and a cover, wherein the cover is attachable to the seat via at least one locking tab extending from the cover.

Clause 20: The trimmer razor as recited in Clause 19, wherein the at least one locking tab comprises a locking hook configured to latch onto the seat to clamp the cover to the seat.

Further details and advantages will be understood from the following detailed description read in conjunction with the accompanying drawings.

DESCRIPTION OF THE DISCLOSURE

For purposes of the description hereinafter, spatial orientation terms, as used, shall relate to the referenced aspect as it is oriented in the accompanying drawings, figures, or otherwise described in the following detailed description. However, it is to be understood that the aspects described hereinafter may assume many alternative variations and configurations. It is also to be understood that the specific components, devices, features, and operational sequences illustrated in the accompanying drawings, figures, or otherwise described herein are simply exemplary and should not be considered as limiting.

The present disclosure is directed to, in general, a razor and, in particular, a trimmer razor with replaceable blades. Certain preferred and non-limiting aspects of the components of the trimmer razor are illustrated in FIGS. 1-22.

With reference to FIGS. 1-7, one aspect of a trimmer razor 2 (hereinafter referred to as "razor 2") is described. The razor 2 may include a handle 4 and a head 6. In one aspect, the head 6 is held stationary relative to the handle 4. In another aspect, the head 6 may be pivotable or rotatable relative to or about the handle 4. The head 6 may have a substantially rectangular shape. In one aspect, the handle 4 may have a substantially cylindrical cross-sectional shape. However, it is also contemplated that alternative shapes may be used, such as triangular, oval, square, or trapezoidal. The handle 4 may include different types of surfaces, including small protrusions, bumps, waves, or indentations 8, to provide a comforting ergonomic feel when held by an individual.

Figure 1:
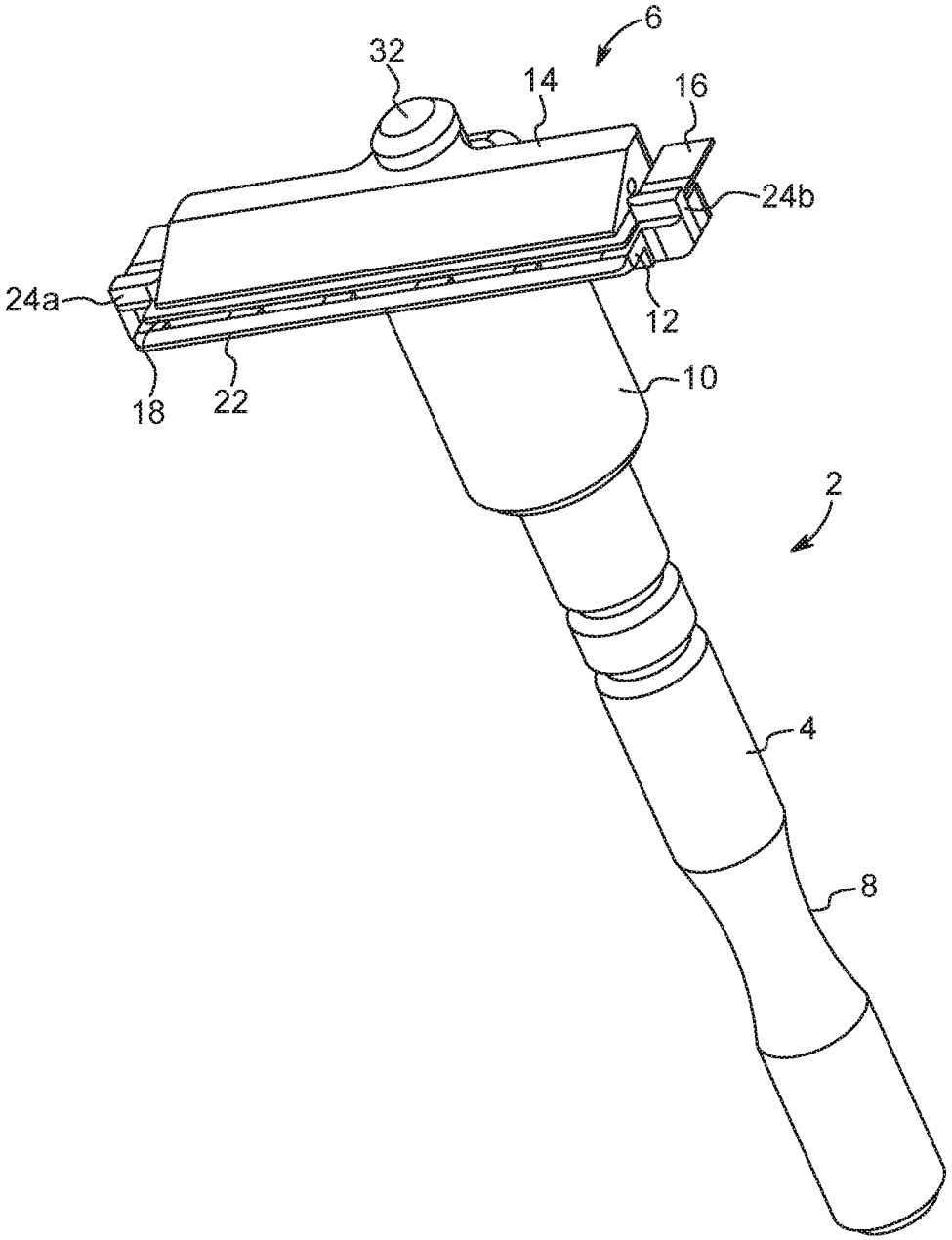
FIG. 1 is a perspective view of a razor in accordance with one aspect of the present disclosure.
Figure 2:
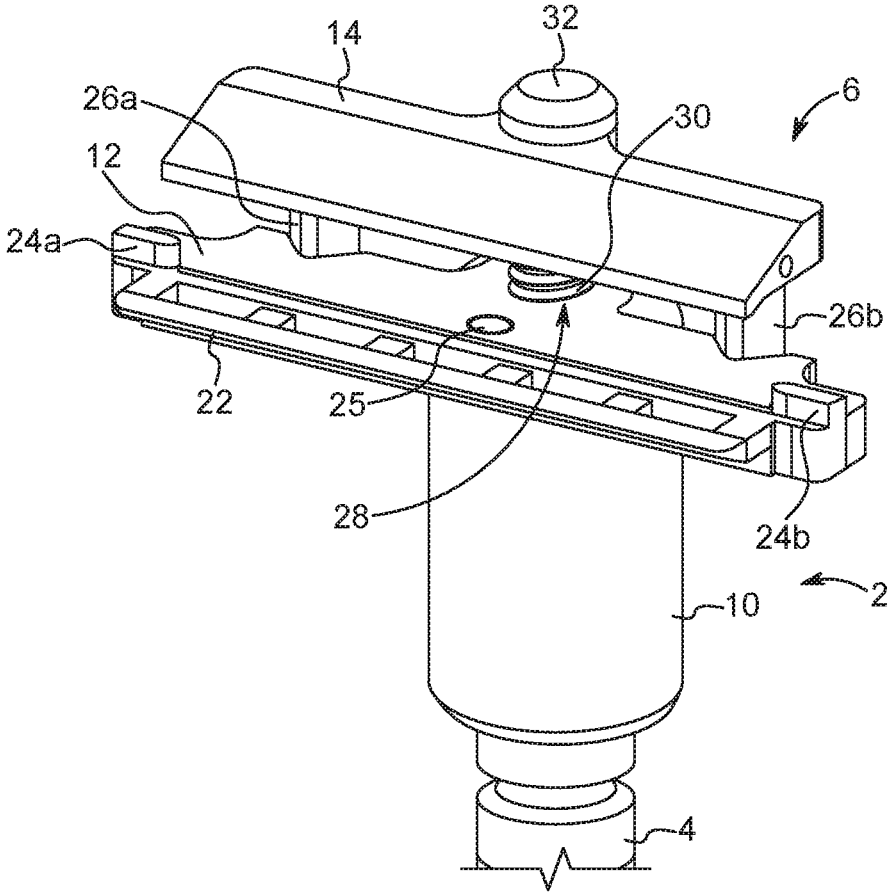
FIG. 2 is a perspective view of a head of the razor of FIG. 1 in an open position without a razor blade.
Figure 3:
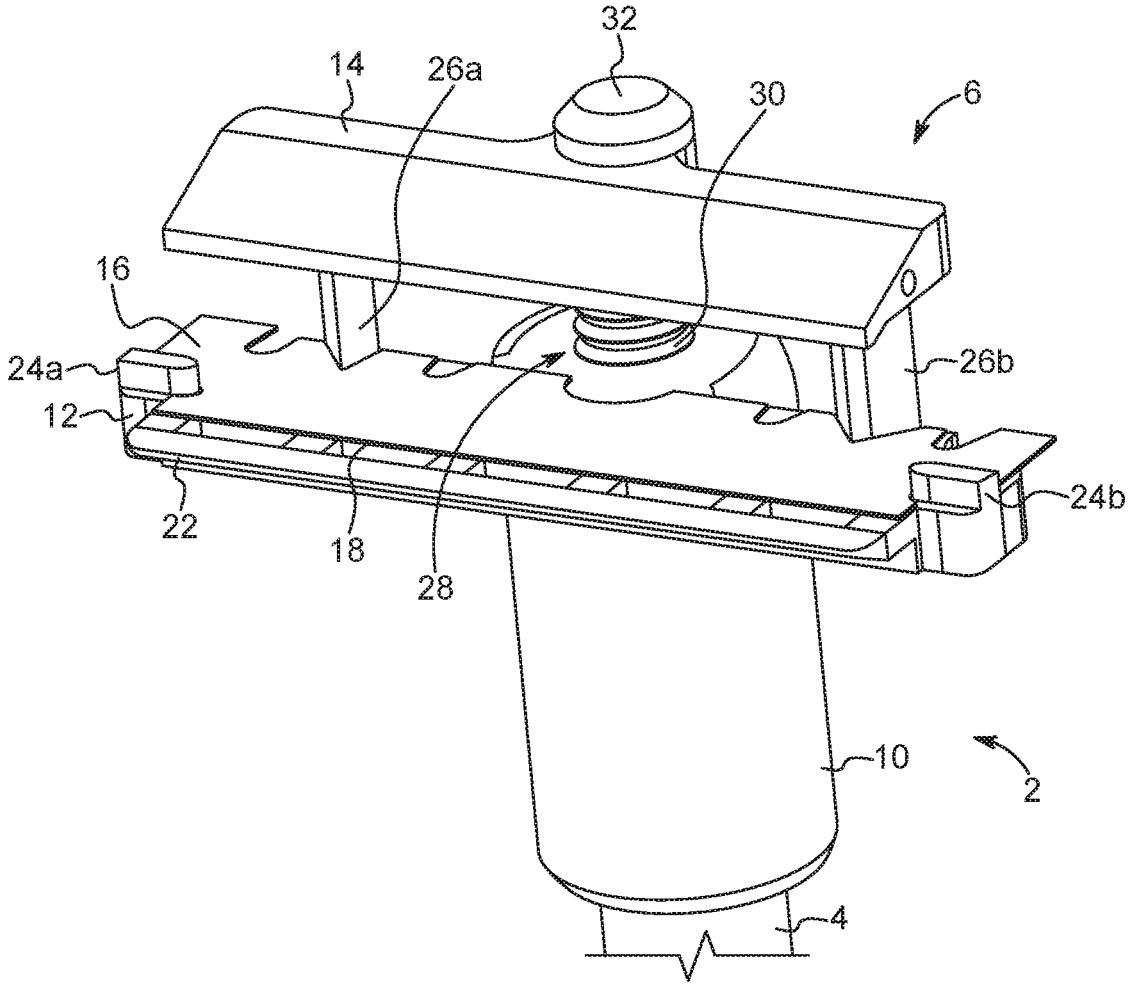
FIG. 3 is a perspective view of the head of the razor of FIG. 1 in an open position with a razor blade inserted therein.
Figure 4:
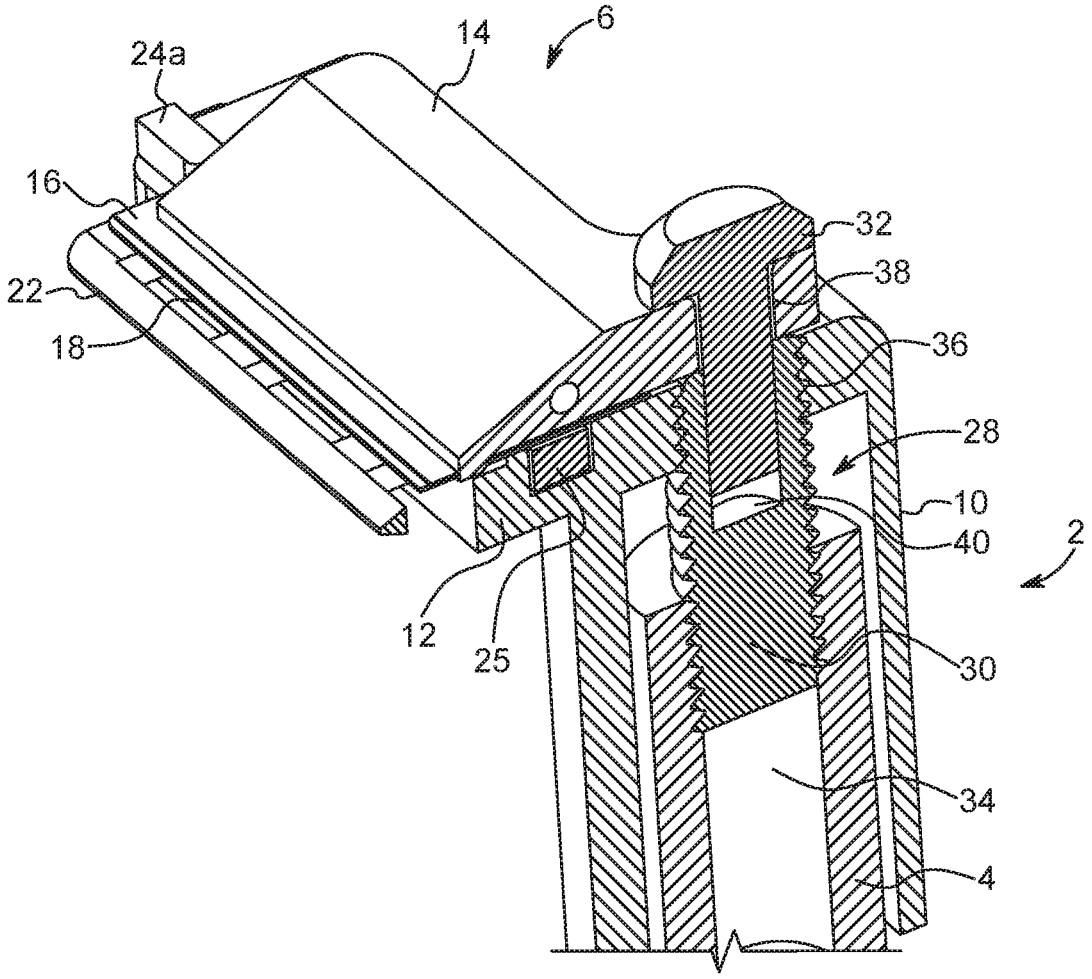
FIG. 4 is a cross-sectional perspective view of the head of the razor of FIG. 1 in a closed position.
Figure 5:
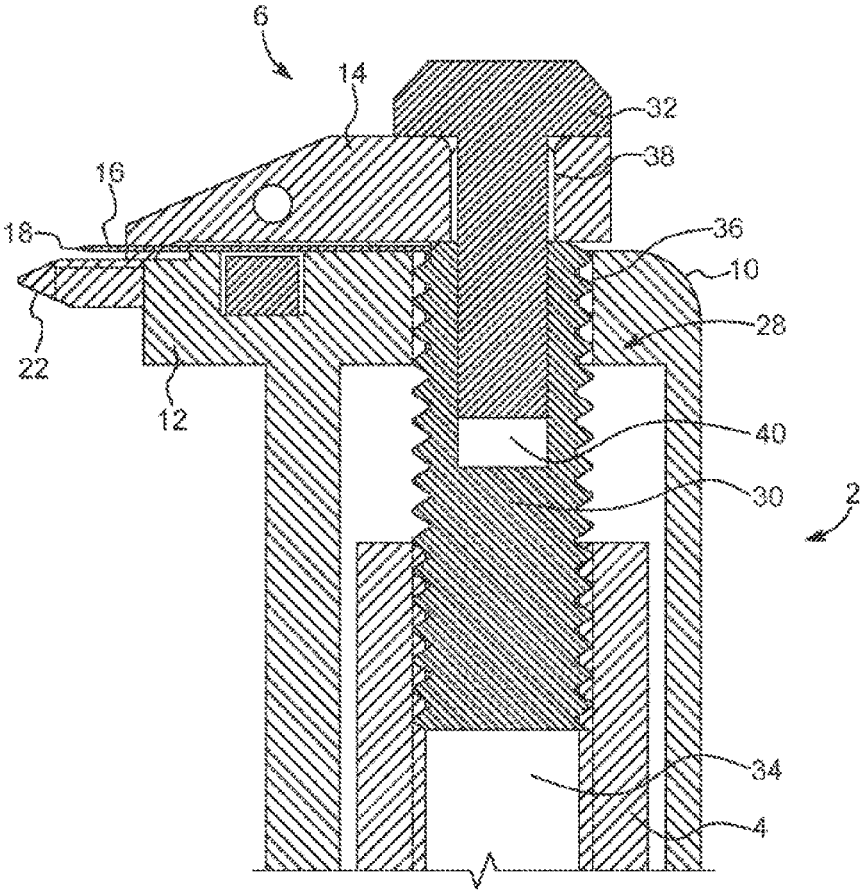
FIG. 5 is a cross-sectional side view of the head of the razor of FIG. 1 in the closed position.
Figure 6:
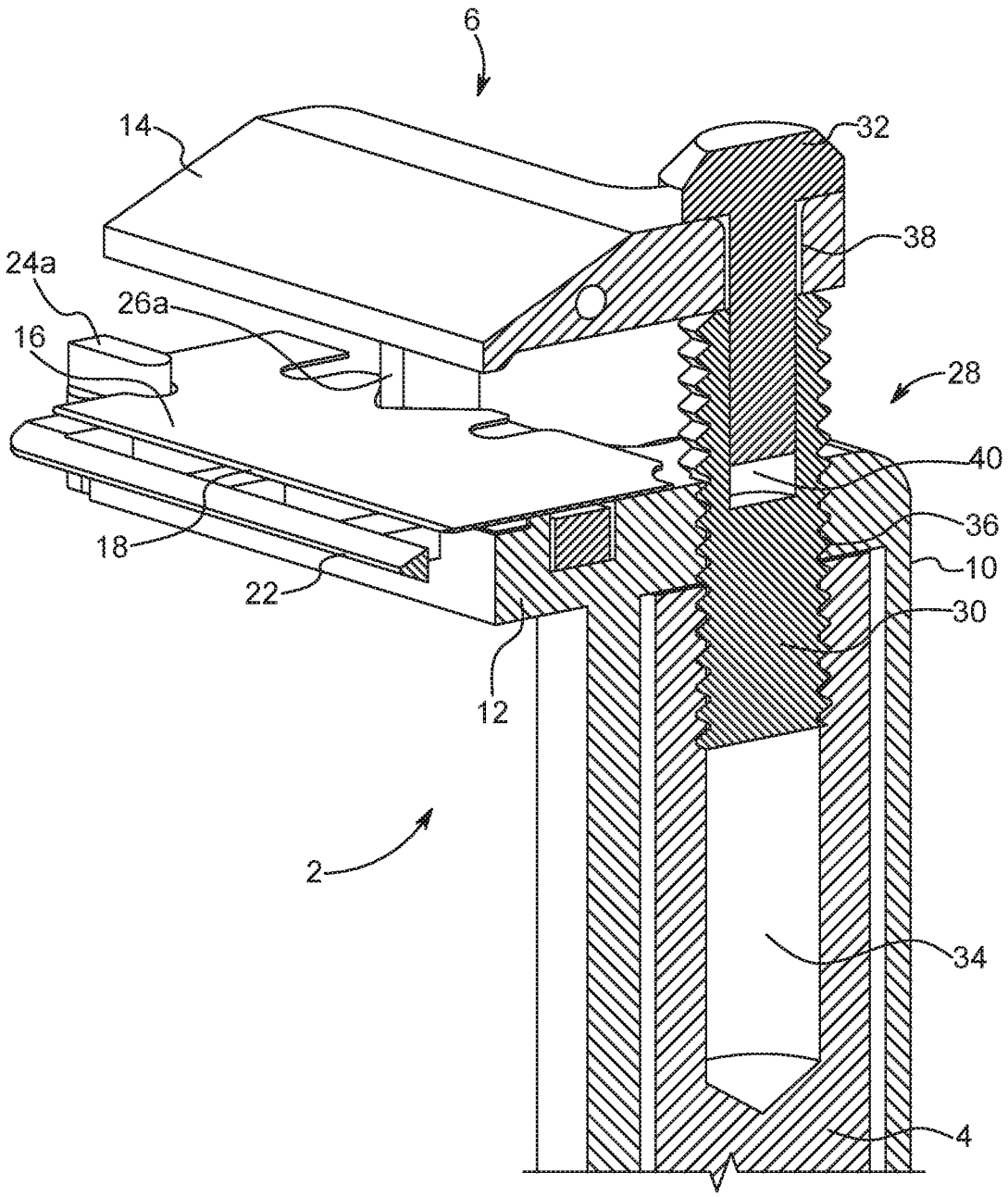
FIG. 6 is a cross-sectional perspective view of the head of the razor of FIG. 1 in the open position.
Figure 7:
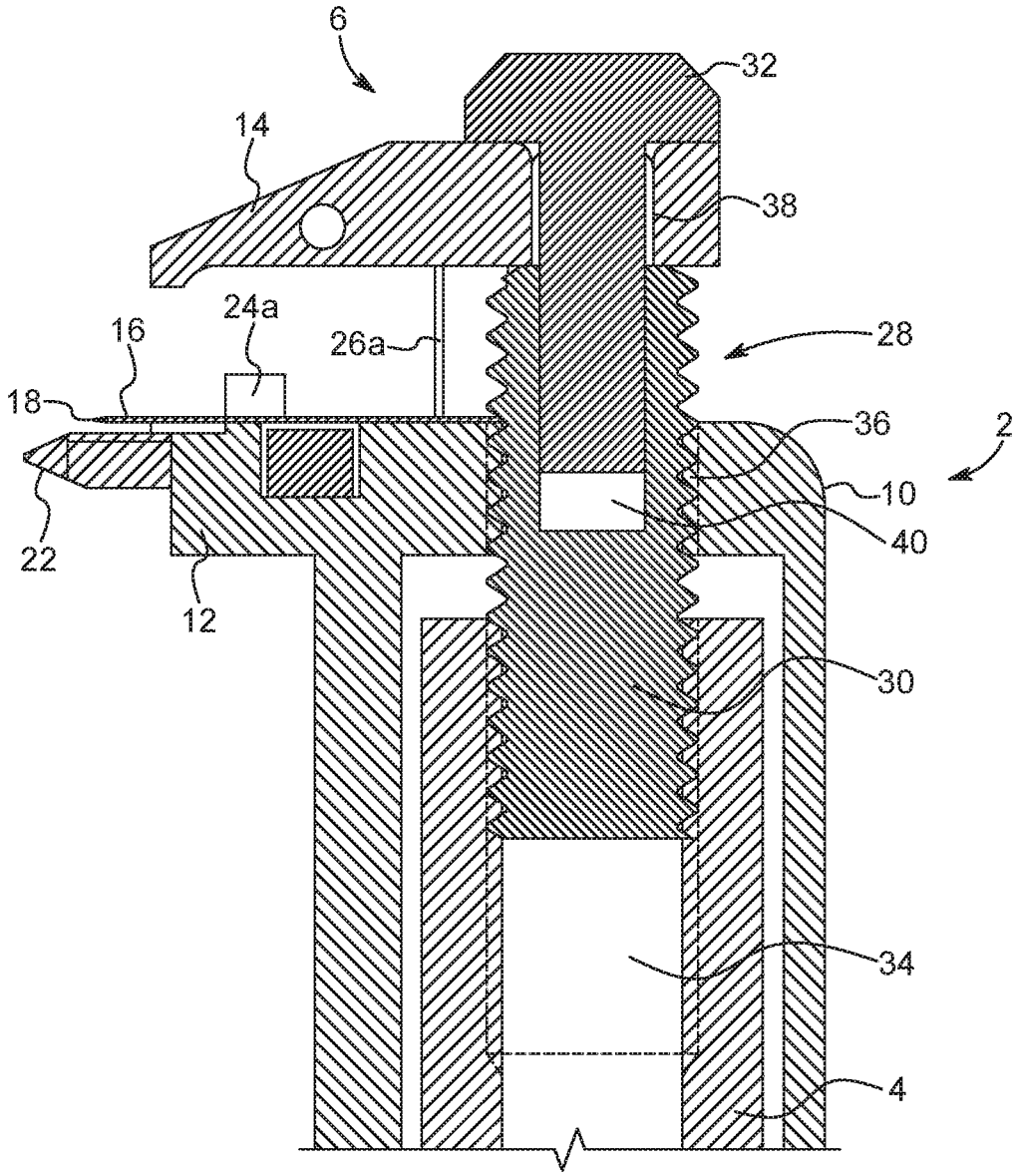
FIG. 7 is a cross-sectional side view of the head of the razor of FIG. 1 in the open position.

With reference to FIG. 2, in one aspect, the head 6 includes a base member 10 operatively connected to the handle 4, as described below, a seat 12 formed on the base member 10, and a cover 14 operatively connected to the base member 10 and the handle 4. The base member 10 is substantially cylindrical and is dimensioned to fit around an outer surface of one end of the handle 4. In one aspect, the inner diameter of the base member 10 is slightly larger than the outer diameter of the end of the handle 4 so the base member 10 fits around the outer surface of the end of the handle 4. The seat 12 is formed on the base member 10 and extends from an upper surface of the base member 10. The seat 12 is configured to receive and hold a razor blade 16 within the razor 2. The seat 12 includes a guard member 22 that extends along the length of a front end of the seat 12. In one aspect, at least two protrusions 24*a*, 24*b* extend from an upper surface of the seat 12. The protrusions 24*a*, 24*b* assist in positioning and retaining the razor blade 16 in a proper orientation on the seat 12. The protrusions 24*a*, 24*b* are positioned on the seat 12 so that the razor blade 16 rests against the protrusions 24*a*, 24*b* and extends from the head 6 to allow shaving with the razor blade 16. The protrusions 24*a*, 24*b* also assist in retaining and holding the razor blade 16 within the head 6 so that the razor blade 16 does not slide out of the head 6. The protrusions 24*a*, 24*b* may constrain the razor blade 16 in two degrees of freedom on the seat 12. As shown in FIG. 2, a magnet 25 may also be provided in an aperture defined in the seat 12 to assist in securing the razor blade 16 within the head 6. The magnet 25 also assists in holding the razor blade 16 to the seat 12 while the user aligns the razor blade 16 with the protrusions 24*a*, 24*b*. Although the use of only one magnet 25 is shown with the razor 2, it is also contemplated that additional magnets may be provided in the seat 12 and/or the cover 14 to assist in holding the razor blade 16 within the head 6.

Figure 14:
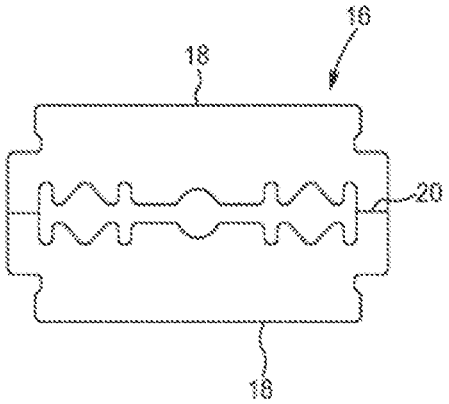
FIG. 14 is a top view of a razor blade used with the razor of the present application.

In one aspect, the blade 16 is formed from a double-edged razor blade. An example of such a double-edge razor blade 16 is shown in FIG. 14. As used herein, the "shaving edge" or like terms of the razors of the present invention refers to a leading surface or portion of the head 6, such that, when in use, the shaving edge is followed by the exposed razor edges 18 that contact a user's skin. Typically, double-edged razor blades include two opposing razor edges 18 connected by a weak or thin body member 20 that defines a perimeter profile and a profiled cut-out. The razor blade 16 is shown as a conventional double-edged blade, but this is not meant to be limiting. It should be appreciated that the razor edge 18 of the razor blade 16 includes an outermost edge for contacting skin with the razor edge 18 tapering from the razor body 20. Other embodiments of razor blades (single-edged and double-edged) with various perimeter profiles and/or central cut-out profiles are encompassed within the present invention. Presently, many manufacturers make these types of double-edged razor blades that use a standardized shape to fit in traditional safety razors. In one aspect, the blade 16 of the razor 2 may be this type of double-edged blade. By "weak and thin", it is meant that the blades are typically designed so that an individual can break a double-edged razor blade in half by hand, splitting along a centerline of the profile cut-out. By breaking the double-edged razor blades in half, two "half blades" or two halves of the double-edged razor blade are provided. Each half may include one razor edge 18. It is also to be understood that the "half blades" may be provided in this initial form, without the need for breaking a double-edged razor blade in half. While it is contemplated that any type of double-edged razor blade may be used with the razor 2, it is also contemplated that specific "half blades" may be designed and configured to custom fit in the seat 12 and cover 14 of the head 6.

With reference to FIGS. 3-7, the cover 14 of the head 6 is slidable between an open position and a closed position. In the open position, the cover 14 is positioned for removal and/or insertion of a razor blade 16 within the head 6. In the closed position, the cover 14 is positioned to hold the razor blade 16 within the head 6 to permit a user to shave with the razor 2. The cover 14 extends along the head 6 to substantially cover the razor blade 16 when the razor blade 16 is held within the head 6. In one aspect, the cover 14 includes two extension members 26*a*, 26*b* that extend from a bottom surface of the cover 14 and are received within the seat 12. The extension members 26*a*, 26*b* are slidably positioned within the seat 12 to guide the cover 14 when moving relative to the seat 12. Furthermore, the extension members 26*a*, 26*b* prevent the cover 14 from rotating relative to the seat 12 when the cover 14 is moved between the open and closed positions.

With reference to FIGS. 4-7, an extension arrangement 28 is provided between the cover 14, the base member 10, and the handle 4 to assist in moving the cover 14 relative to the seat 12. The extension arrangement 28 includes a screw member 30 and a fastener 32. One end of the screw member 30 is threaded into and held within the handle 4. The top end of the handle 4 defines a cavity 34 that includes a threaded inner surface to receive one end of the screw member 30. A second end of the screw member 30 is threaded into a threaded aperture 36 defined in the base member 10. The extension arrangement 28 is operatively connected to the cover 14 using the fastener 32. The fastener 32 is inserted through an aperture 38 defined in the cover 14 and received in a cavity 40 defined in the screw member 30. The cavity 40 is defined by an upper end of the screw member 30. The fastener 32 is held in the cavity 40 of the screw member 30 via a friction fit. It is also contemplated that the fastener 32 may be welded or molded within the cavity 40 of the screw member 30. When assembled, the fastener 32 is positioned within the extension arrangement 28 to clamp the cover 14 between the fastener 32 and the base member 10.

With continued reference to FIGS. 4-7, operation of the extension arrangement 28 is described. As the handle 4 is rotated, the screw member 30 moves through the aperture 36 to raise or lower the cover 14 relative to the seat 12. In one aspect, when the handle 4 is rotated in a counterclockwise direction, the screw member 30 is moved upwardly through the aperture 36. The screw member 30 moves upwardly through the aperture 36 until the upper end of the handle 4 contacts the base member 10. Since the cover 14 is clamped between the fastener 32 and the screw member 30, as the screw member 30 moves upwardly through the aperture 36, the cover 14 is also raised upwardly relative to the seat 12. By raising the cover 14 relative to the seat 12, the head 6 is moved to the open position to allow a user to remove and/or insert a razor blade 16 on the seat 12 of the head 6.

In one aspect, as the handle 4 is rotated in a clockwise direction, the screw member 30 is moved downwardly through the aperture 36. The screw member 30 moves downwardly through the aperture 36 until the bottom surface of the cover 14 contacts the base member 10. Since the cover 14 is clamped between the fastener 32 and the screw member 30, as the screw member 30 moves downwardly through the aperture 36, the cover 14 is also moved downwardly relative to the seat 12. By lowering the cover 14 relative to the seat 12, the head 6 is moved to the closed position to clamp the razor blade 16 against the seat 12 within the head 6.

The razor 2 can serve as a trimmer razor that can be used separate from conventional cartridge razors and uses low cost thin metal blades, such as the double edged blade. The razor 2 includes a low profile to provide better access to hard-to-reach areas, as well as provide better visualization of where the razor blades 16 will shave on the user's skin surface to produce fine and more accurate shaving lines. Since the razor 2 is decoupled from any other blades used to shave a user's skin surface, the razor blade 16 installed in the razor 2 lasts much longer than traditional trimmer blades incorporated within multi-blade razor cartridges. This longevity of the trimmer razor 2, coupled with the type of blades that are used in the razor 2, provide a low ongoing cost to the user to use such a trimmer razor 2.

Figure 8:
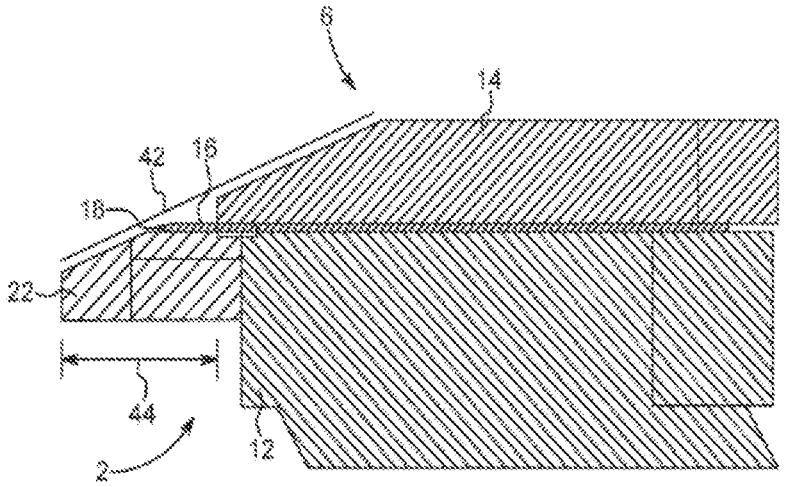
FIG. 8 is a side view of a head of a razor according to one aspect of the present disclosure.

As shown in FIG. 8, the razor 2 accepts the razor blade 16 and places the blade 16 in a precise and repeatable position that allows the user to shave comfortably with the blade 16 in an optimal position for hair removal from the user's skin surface. The outer surface of the cover 14 and the seat 12 create a shave plane 42 that is configured to assist the user in positioning the razor 2 in the correct orientation on the user's skin surface. By pressing the shave plane 42 against the user's skin surface, the blade 16 is oriented in a shaving position so that the blade 16 shaves the user's hair. Conventional double-edged razors have a curved shave plane surface, necessitating the need to hold the razor at a precise angle while shaving. Some users find this additional level of control to be difficult and time consuming. The razor 2 of the present disclosure provides a substantially flat or planar shave plane 42 that the user's skin surface conforms to, making the task of holding the razor 2 at the correct angle less important. This makes the user of the razor 2 of the present disclosure easier than the use of conventional double-edged razors and reduces the chances of nicks, cuts, and skin irritation. In one aspect, the seat 12 also provides a shaving gap 44 between the leading edge of the cover 14 and the leading edge of the seat 12. The leading edges of the seat 12 and the cover 14 are considered to be the edges of the seat 12 and cover 14 that contact the user's skin surface when using the razor 2. The size of the shaving gap 44 determines the amount of the user's skin surface that is exposed to the razor blade 16 prior to the razor edge 18 of the razor blade 16 contacting the user's skin surface.

Figure 9:
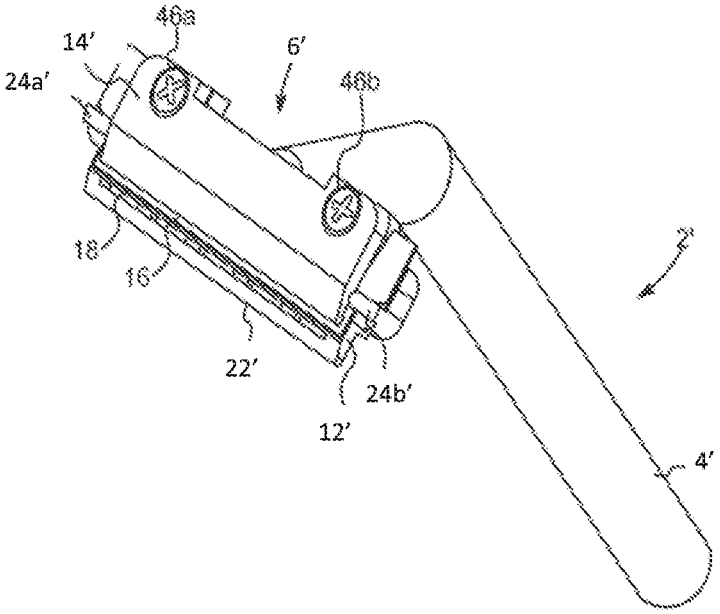
FIG. 9 is a perspective view of a razor according to another aspect of the present disclosure.
Figure 10:
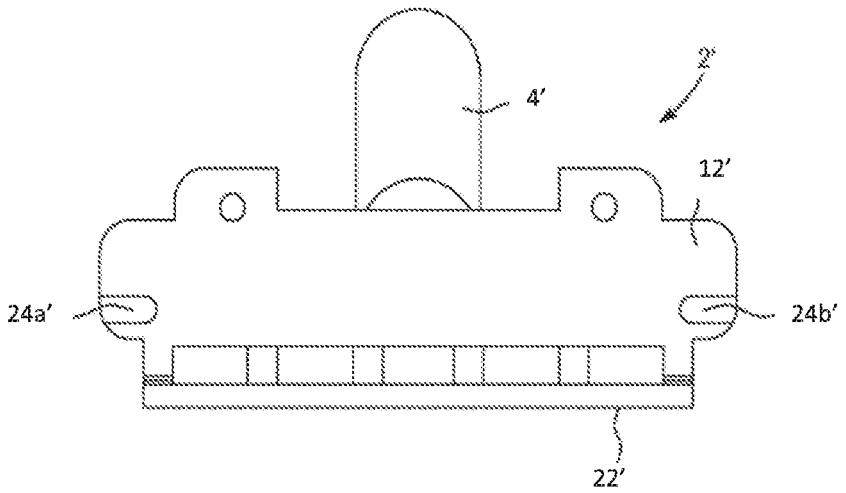
FIG. 10 is a top view of a head of the razor of FIG. 9 without a razor blade held thereon.
Figure 11:
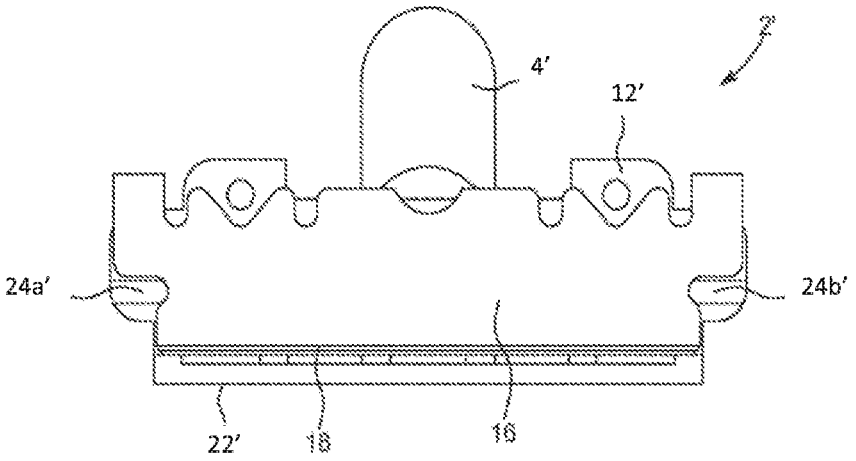
FIG. 11 is a top view of the head of the razor of FIG. 9 with a razor blade held thereon.
Figure 12:
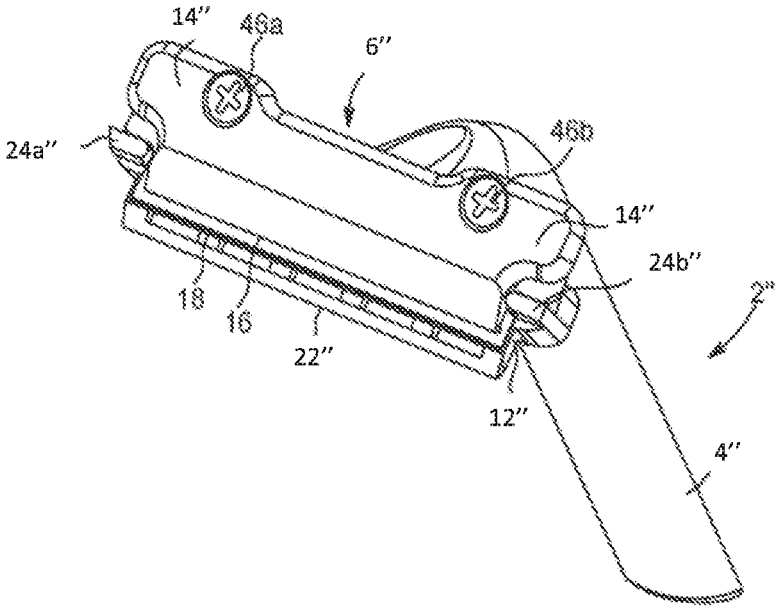
FIG. 12 is a perspective view of a razor according to another aspect of the present disclosure.

With reference to FIG. 9-11, in another aspect of the disclosure, a razor 2' includes a different clamping mechanism to hold the razor blade 16 within the head 6'. This aspect of the razor 2' does not utilize the extension arrangement 28 to move the cover 14' relative to the seat 12'. Instead, two fasteners 46*a*, 46*b* extend through the cover 14' and into the seat 12'. In one aspect, the fasteners 46*a*, 46*b* are screws that can be rotated to tighten and clamp the cover 14' to the seat 12'. The fasteners 46*a*, 46*b* can be unscrewed to move the cover 14' to an open position to permit the user to remove and/or insert the razor blade 16 into the head 6'. The fasteners 46*a*, 46*b* can also be screwed and tightened to clamp the razor blade 16 between the seat 12' and the cover 14'. Although screws are used as the fasteners 46*a*, 46*b* in FIG. 9, it is also contemplated that other types of fasteners can be used to tighten and loosen the cover 14' to the seat 12'. As shown in FIGS. 10 and 11, the razor 2' also includes similar protrusions 24*a*', 24*b*' to constrain the razor blade 16 in two degrees of freedom. As shown in FIG. 12, in another aspect, the razor 2" the ends of the cover 14" are extended over the ends of the razor blade 16 to prevent the user from cutting him/herself on the sides of the razor blade 16. In this aspect, the length of the cover 14" is substantially equal to the length of the razor blade 16 and the length of the seat 12" As shown in FIG. 12, the razor 2" also includes similar protrusions 24*a*", 24*b*" to constrain the razor blade 16 in two degrees of freedom. The seat 12" may include a guard member 22" that extends along the length of a front end of the seat 12".

Figure 13:
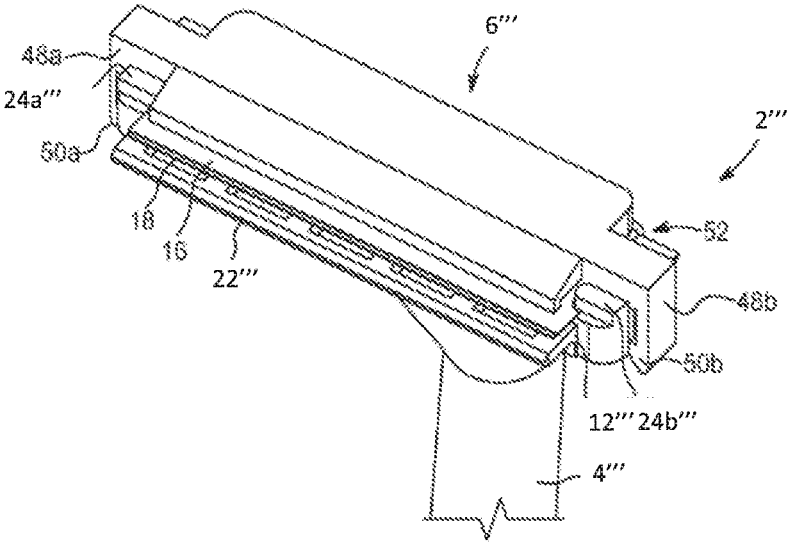
FIG. 13 is a perspective view of a head of a razor according to another aspect of the present disclosure.

With reference to FIG. 13, another aspect of a razor 2''' is described. In this aspect, instead of using the extension arrangement 28 or the fasteners 46*a*, 46*b* to clamp the cover 14''' to the seat 12''', a pair of locking tabs 48*a*, 48*b* extend from the ends of the cover 14''' to hold the cover 14''' to the seat 12'''. The locking tabs 48*a*, 48*b* extend downward from a top surface of the cover 14''' towards the seat 12'''. One end of each locking tab 48*a*, 48*b* includes a locking hook 50*a*, 50*b* that is used to latch the locking tabs 48*a*, 48*b* on the seat 12'''. In one aspect, the locking hooks 50*a*, 50*b* latch onto a bottom surface of the seat 12'''. In another aspect, the locking hooks 50*a*, 50*b* latch onto a protrusion that extends from the seat 12'''. In one aspect, the locking tabs 48*a*, 48*b* are at least partially elastic to permit a user to bend the locking tabs 48*a*, 48*b* outwards away from the seat 12''' to move the cover 14''' onto the seat 12'''. After the cover 14''' has been clamped on the seat 12''', the locking tabs 48*a*, 48*b* are released to snap back into place and lock the cover 14''' in the clamping position against the seat 12''' to hold the razor blade 16 therebetween. It is also contemplated that the user may press down on the upper surface of the cover 14''', thereby forcing the locking tabs 48*a*, 48*b* to move outwardly until the locking hooks 50*a*, 50*b* latch onto the seat 12'''. As shown in FIG. 13, in this aspect, the cover 14''' is connected to the seat 12''' via a hinge 52. In this aspect, the cover 14''' is rotatable relative to the seat 12''' to permit access to the seat 12''' for removing and/or replacing the razor blade 16 therein. It is also contemplated that the cover 14''' is only held on the seat 12''' using the locking tabs 48*a*, 48*b*. As shown in FIG. 13, the razor 2''' also includes similar protrusions 24*a*'''', 24*b*'''' to constrain the razor blade 16 in two degrees of freedom.

With reference to FIGS. 15-22, one aspect of a trimmer razor 102 (hereinafter referred to as "razor 102") is described. The razor 102 may include a handle 104 and a head 106. In one aspect, the head 106 is held stationary relative to the handle 104. In another aspect, the head 106 may be pivotable or rotatable relative to or about the handle 104. The head 106 may have a substantially rectangular shape. In one aspect, the handle 104 may have a substantially cylindrical cross-sectional shape. However, it is also contemplated that alternative shapes may be used, such as triangular, oval, square, or trapezoidal. The handle 104 may include different types of surfaces, including small protrusions, bumps, waves, or indentations 108, to provide a comforting ergonomic feel when held by an individual.

Figure 15:
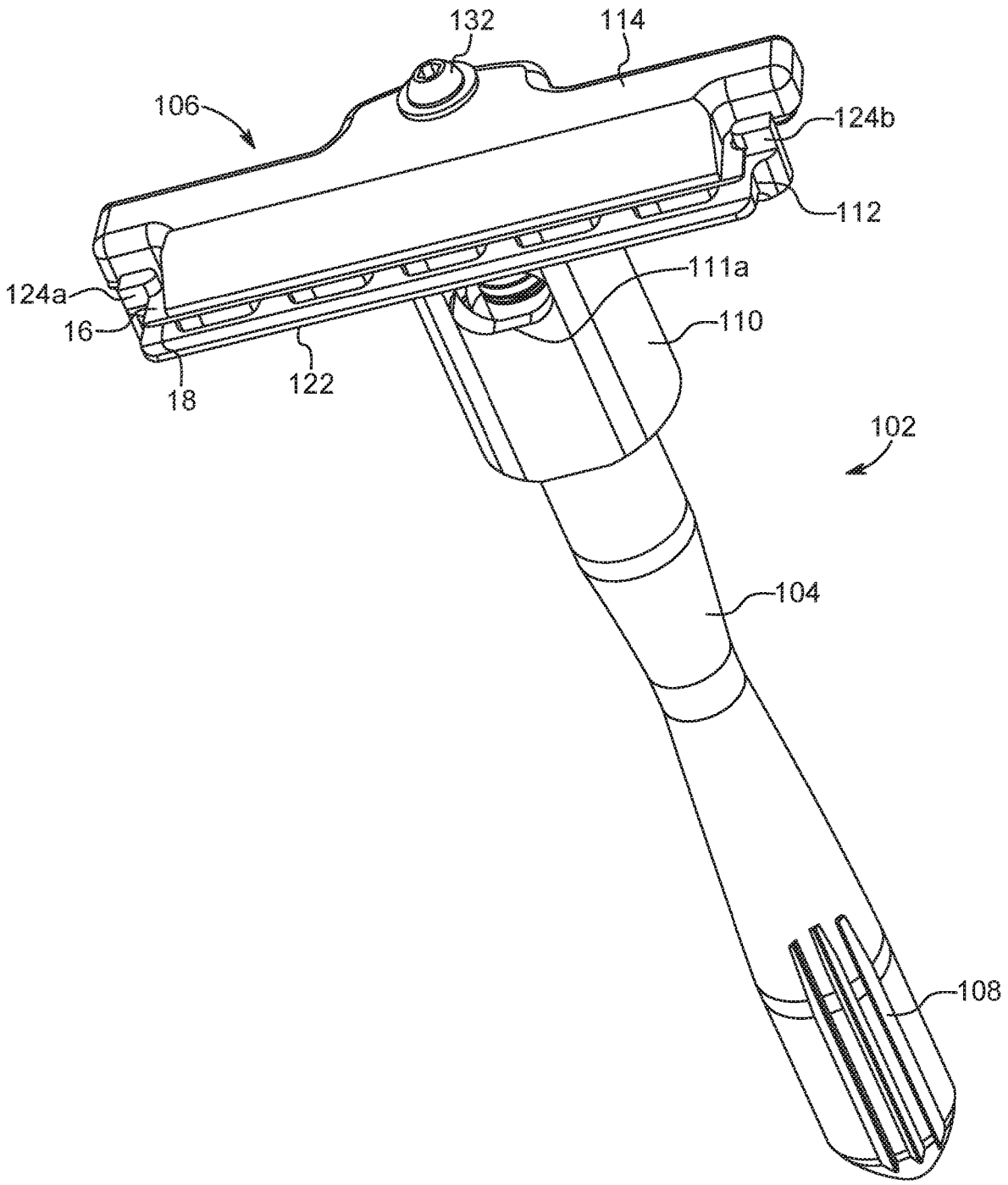
FIG. 15 is a front perspective view of a razor in accordance with one aspect of the present disclosure.
Figure 16:
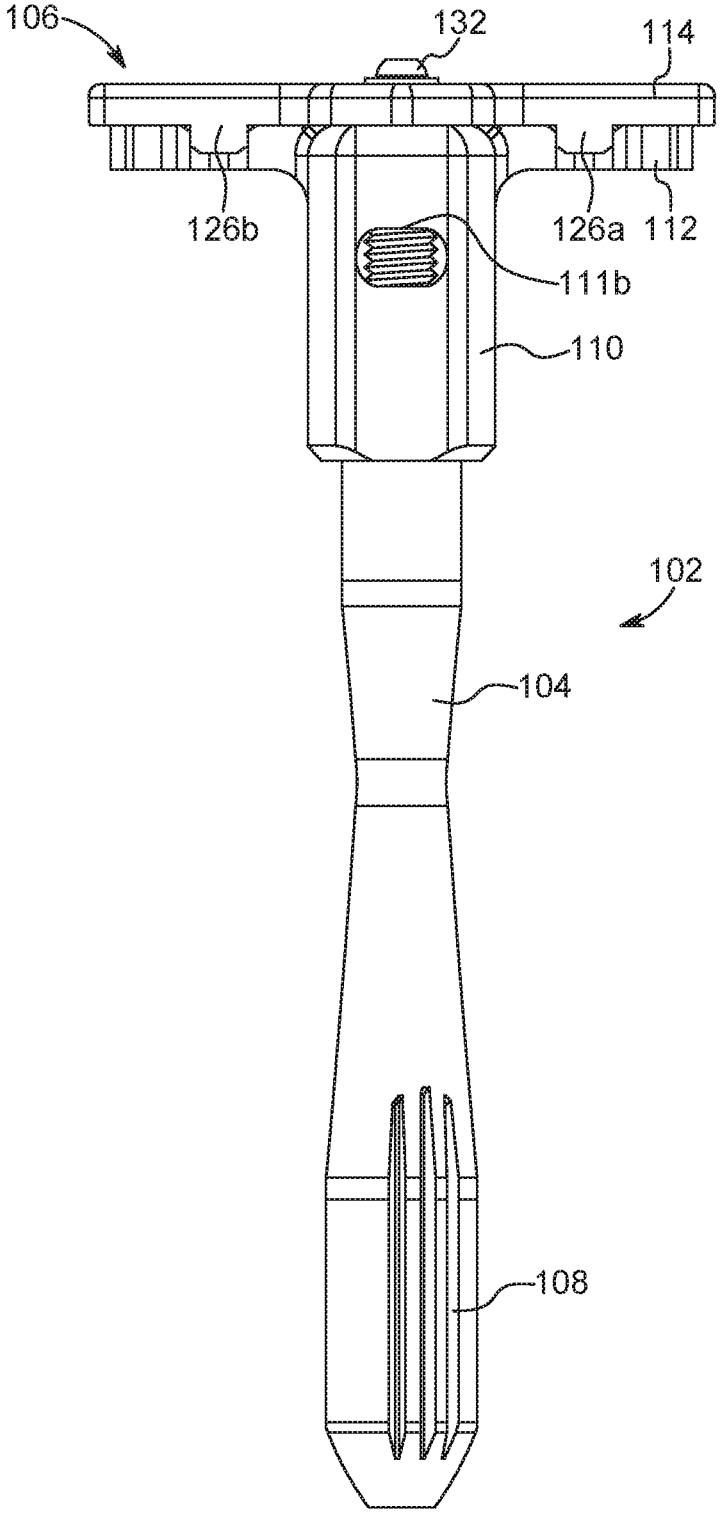
FIG. 16 is a rear view of the razor of FIG. 15.
Figure 17:
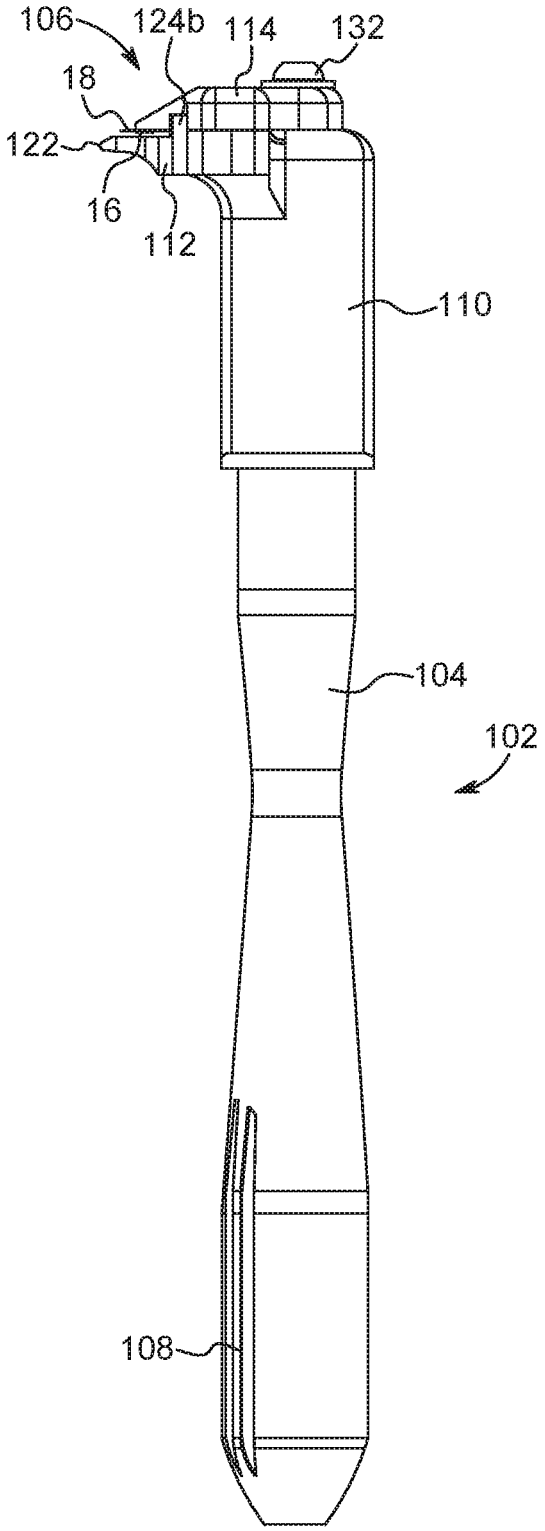
FIG. 17 is a side view of the razor of FIG. 15.
Figure 21:
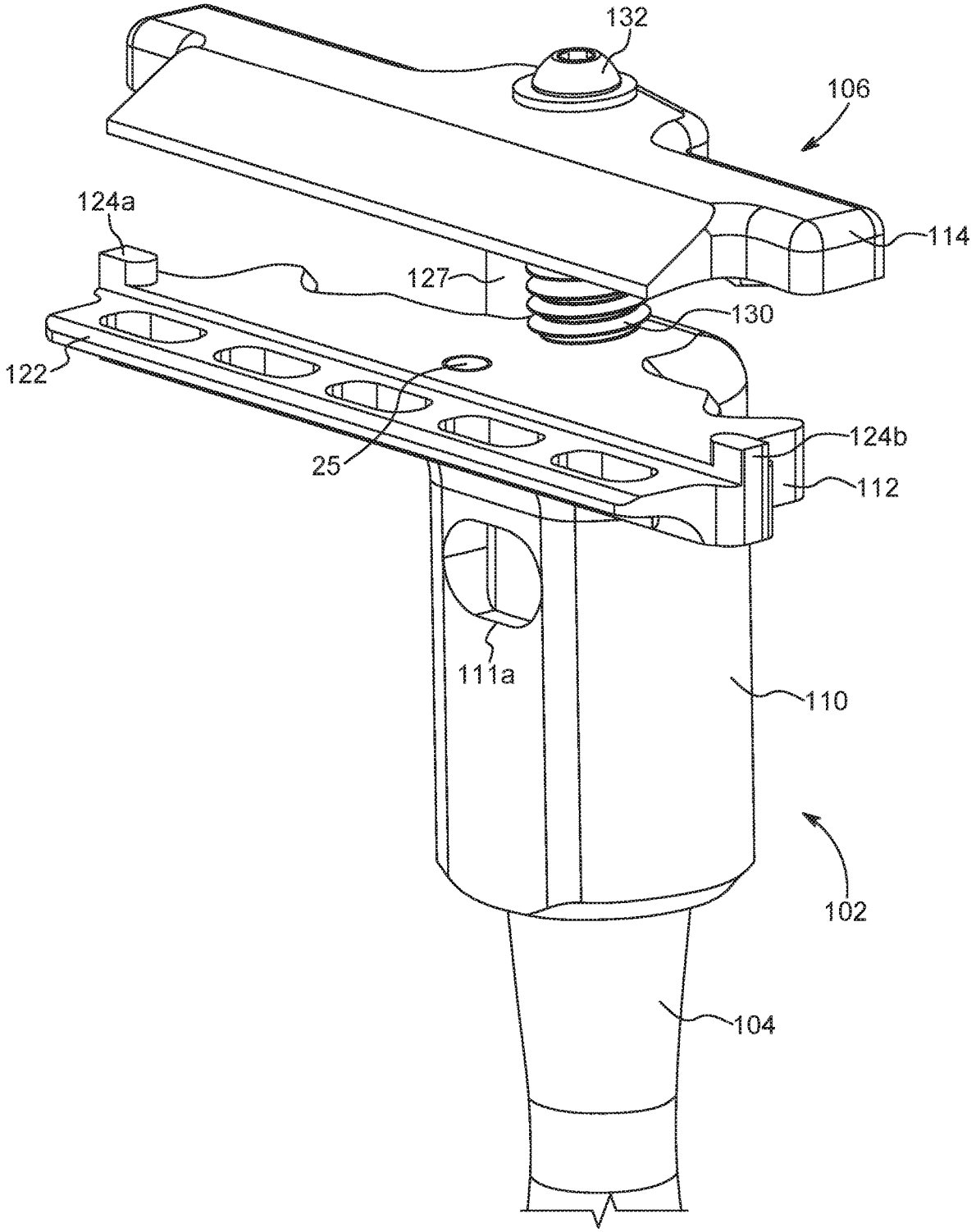
FIG. 21 is a front perspective view of the head of the razor of FIG. 15 with the head in the open position.

With reference to FIG. 15, in one aspect, the head 106 includes a base member 110 operatively connected to the handle 104, as described below, a seat 112 formed on the base member 110, and a cover 114 operatively connected to the base member 110 and the handle 104. The base member 110 is substantially cylindrical and is dimensioned to fit around an outer surface of one end of the handle 104. In one aspect, the inner diameter of the base member 110 is slightly larger than the outer diameter of the end of the handle 104 so the base member 110 fits around the outer surface of the end of the handle 104. In one aspect, the base member 110 defines a front aperture 111*a* and a rear aperture 111*b* that allows fluid to be flushed or directed out of the base member 110. During use of the razor 102, water or other fluids may leak into the cavity 134 between the bottom end of the base member 110 and the handle 104. This water or fluid can become trapped within the cavity 134 and may create corrosion on the screw member 130. Therefore, by providing the apertures 111*a*, 111*b*, the water or fluid can flush out of the base member 110 without becoming trapped within the cavity 134. The seat 112 is formed on the base member 110 and extends from an upper surface of the base member 110. The seat 112 is configured to receive and hold a razor blade 16 within the razor 102. The seat 112 includes a guard member 122 that extends along the length of a front end of the seat 112. In one aspect, at least two protrusions 124*a*, 124*b* extend from an upper surface of the seat 112. The protrusions 124*a*, 124*b* assist in positioning and retaining the razor blade 16 in a proper orientation on the seat 112. The protrusions 124*a*, 124*b* are positioned on the seat 112 so that the razor blade 16 rests against the protrusions 124*a*, 124*b* and extends from the head 106 to allow shaving with the razor blade 16. The protrusions 124*a*, 124*b* also assist in retaining and holding the razor blade 16 within the head 106 so that the razor blade 16 does not slide out of the head 106. The protrusions 124*a*, 124*b* may constrain the razor blade 16 in two degrees of freedom on the seat 112. As shown in FIG. 21, a magnet 25 may also be provided in an aperture defined in the seat 112 to assist in securing the razor blade 16 within the head 106. The magnet 25 also assists in holding the razor blade 16 to the seat 112 while the user aligns the razor blade 16 with the protrusions 124*a*, 124*b*. Although the use of only one magnet 25 is shown with the razor 102, it is also contemplated that additional magnets may be provided in the seat 112 and/or the cover 114 to assist in holding the razor blade 16 within the head 106.

Figure 19:
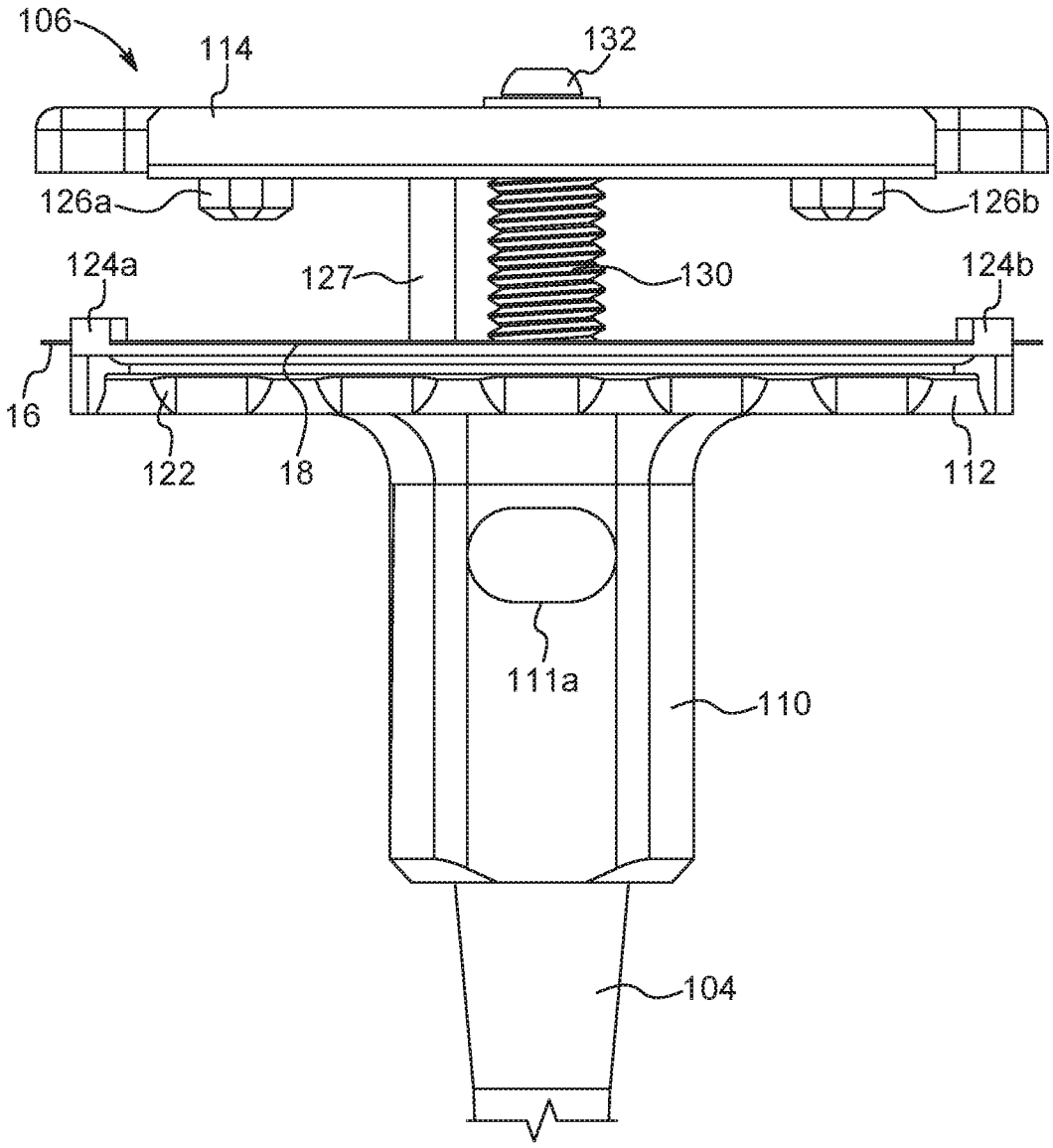
FIG. 19 is a front view of the head of the razor of FIG. 15 with the head in an open position.
Figure 20:
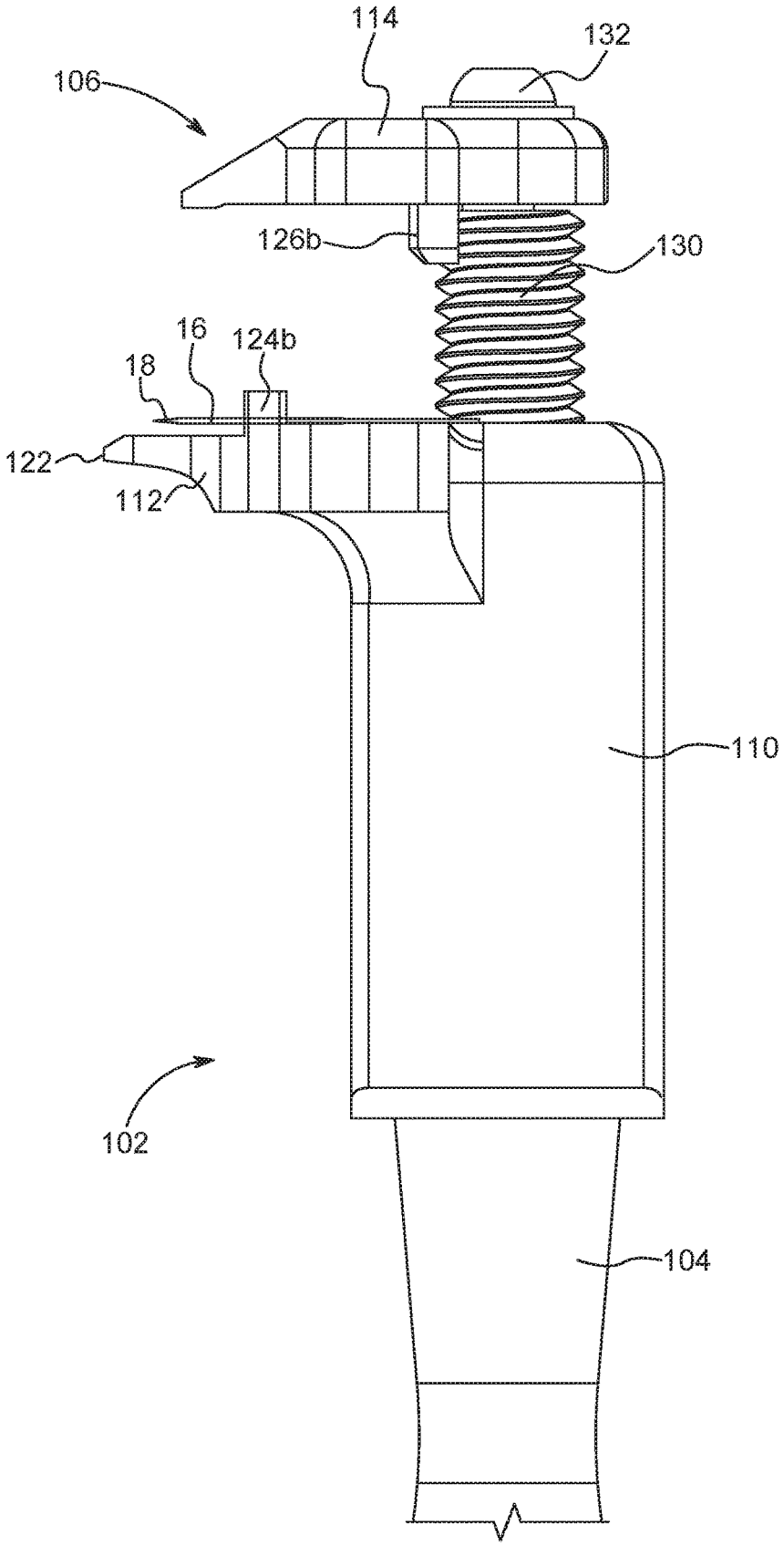
FIG. 20 is a side view of the head of the razor of FIG. 15 with the head in the open position.

With reference to FIGS. 15 and 19, the cover 114 of the head 106 is slidable between an open position and a closed position. In the open position, the cover 114 is positioned for removal and/or insertion of a razor blade 16 within the head 106. In the closed position, the cover 114 is positioned to hold the razor blade 16 within the head 106 to permit a user to shave with the razor 102. The cover 114 extends along the head 106 to substantially cover the razor blade 16 when the razor blade 16 is held within the head 106. In one aspect, the cover 114 includes two extension members 126*a*, 126*b* that extend from a bottom surface of the cover 114 and are received within the seat 112. The extension members 126*a*, 126*b* are slidably positioned within the seat 112 to guide the cover 114 when moving relative to the seat 112. Furthermore, the extension members 126*a*, 126*b* assist in preventing the cover 114 from rotating relative to the seat 112 when the cover 114 is held in the closed position. The cover 114 may also include a dowel pin 127 that is attached to a bottom surface of the cover 114. The dowel pin 127 is slidably received within an aperture defined in a top surface of the base member 110 and prevents the cover 114 from rotating relative to the seat 112 when the cover 114 is moved between the open and closed positions.

Figure 18:
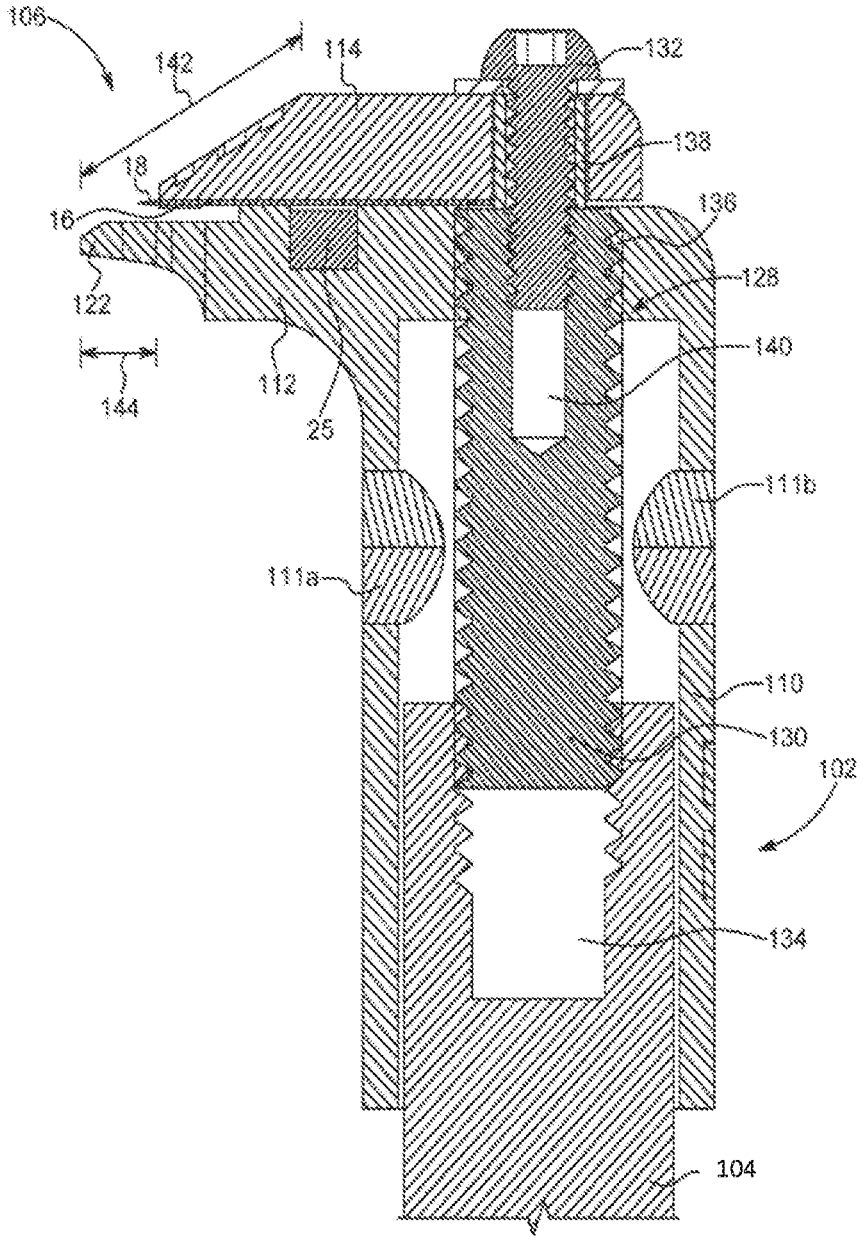
FIG. 18 is a cross-sectional side view of a head of the razor of FIG. 15.

With reference to FIG. 18, an extension arrangement 128 is provided between the cover 114, the base member 110, and the handle 104 to assist in moving the cover 114 relative to the seat 112. The extension arrangement 128 includes a screw member 130 and a fastener 132. One end of the screw member 130 is threaded into and held within the handle 104. The top end of the handle 104 defines a cavity 134 that includes a threaded inner surface to receive one end of the screw member 130. A second end of the screw member 130 is threaded into a threaded aperture 136 defined in the base member 110. The extension arrangement 128 is operatively connected to the cover 114 using the fastener 132. The fastener 132 is inserted through an aperture 138 defined in the cover 114 and received in a cavity 140 defined in the screw member 130. The cavity 140 is defined by an upper end of the screw member 130. The fastener 132 is held in the cavity 140 of the screw member 130 via a friction fit. It is also contemplated that the fastener 132 may be welded or molded within the cavity 140 of the screw member 130. When assembled, the fastener 132 is positioned within the extension arrangement 128 to clamp the cover 114 between the fastener 132 and the base member 110.

With continued reference to FIG. 18, operation of the extension arrangement 128 is described. As the handle 104 is rotated, the screw member 130 moves through the aperture 136 to raise or lower the cover 114 relative to the seat 112. In one aspect, when the handle 104 is rotated in a counterclockwise direction, the screw member 130 is moved upwardly through the aperture 136. The screw member 130 moves upwardly through the aperture 136 until the upper end of the handle 104 contacts the base member 110. Since the cover 114 is clamped between the fastener 132 and the screw member 130, as the screw member 130 moves upwardly through the aperture 136, the cover 114 is also raised upwardly relative to the seat 112. By raising the cover 114 relative to the seat 112, the head 106 is moved to the open position to allow a user to remove and/or insert a razor blade 16 on the seat 112 of the head 106.

In one aspect, as the handle 104 is rotated in a clockwise direction, the screw member 130 is moved downwardly through the aperture 136. The screw member 130 moves downwardly through the aperture 136 until the bottom surface of the cover 114 contacts the base member 110. Since the cover 114 is clamped between the fastener 132 and the screw member 130, as the screw member 130 moves downwardly through the aperture 136, the cover 114 is also moved downwardly relative to the seat 112. By lowering the cover 114 relative to the seat 112, the head 106 is moved to the closed position to clamp the razor blade 16 against the seat 112 within the head 106.

The razor 102 can serve as a trimmer razor that can be used separate from conventional cartridge razors and uses low cost thin metal blades, such as the double edged blade. The razor 102 includes a low profile to provide better access to hard-to-reach areas, as well as provide better visualization of where the razor blades 16 will shave on the user's skin surface to produce fine and more accurate shaving lines. Since the razor 102 is decoupled from any other blades used to shave a user's skin surface, the razor blade 16 installed in the razor 102 lasts much longer than traditional trimmer blades incorporated within multi-blade razor cartridges. This longevity of the trimmer razor 102, coupled with the type of blades that are used in the razor 102, provide a low ongoing cost to the user to use such a trimmer razor 102.

Figure 22:
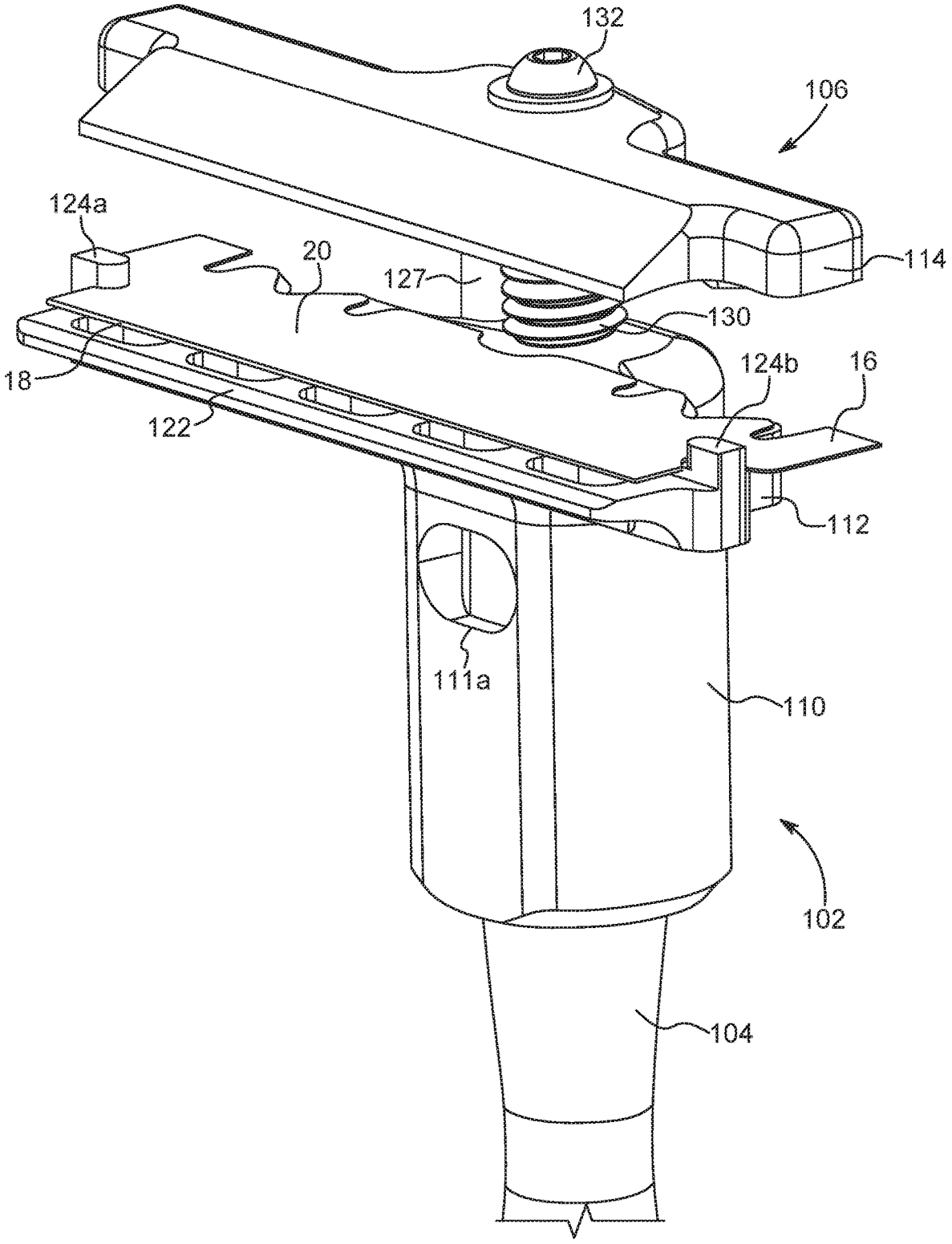
FIG. 22 is a front perspective view of the head of the razor of FIG. 15 with the head in the open position and a razor blade positioned therein.

As shown in FIG. 22, the razor 102 accepts the razor blade 16 and places the blade 16 in a precise and repeatable position that allows the user to shave comfortably with the blade 16 in an optimal position for hair removal from the user's skin surface. The outer surface of the cover 114 and the seat 112 create a shave plane 142 (shown in FIG. 18) that is configured to assist the user in positioning the razor 102 in the correct orientation on the user's skin surface. By pressing the shave plane 142 against the user's skin surface, the blade 16 is oriented in a shaving position so that the blade 16 shaves the user's hair. Conventional double-edged razors have a curved shave plane surface, necessitating the need to hold the razor at a precise angle while shaving. Some users find this additional level of control to be difficult and time consuming. The razor 102 of the present disclosure provides a substantially flat or planar shave plane 142 that the user's skin surface conforms to, making the task of holding the razor 102 at the correct angle less important. This makes the user of the razor 102 of the present disclosure easier than the use of conventional double-edged razors and reduces the chances of nicks, cuts, and skin irritation. In one aspect, the seat 112 also provides a shaving gap 144 (shown in FIG. 18) between the leading edge of the cover 114 and the leading edge of the seat 112. The leading edges of the seat 112 and the cover 114 are considered to be the edges of the seat 112 and cover 114 that contact the user's skin surface when using the razor 102. The size of the shaving gap 144 determines the amount of the user's skin surface that is exposed to the razor blade 16 prior to the razor edge 118 of the razor blade 16 contacting the user's skin surface.

While aspects of a razor are shown in the accompanying figures and described hereinabove in detail, other aspects will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope. It is also contemplated that any feature from one aspect of the disclosure may be incorporated with the features of any other aspect of the disclosure.

The invention claimed is:

1. A trimmer razor, comprising:

a handle;

a head operatively connected to the handle, the head comprising a base member, a seat extending from the base member, and a cover connected to the seat; and an extension arrangement connecting the cover to the handle so that, upon rotation of the handle, the cover is movable between an open position in which the cover is spaced from the seat and a closed position in which the cover is clamped to the seat, wherein the extension arrangement comprises a screw member threadedly connected to each of the handle and the base member, and wherein one end of the handle is received within the base member of the head.

2. The trimmer razor as claimed in claim 1, wherein a shaving gap is defined between a front edge of the cover and a front edge of the seat.

3. The trimmer razor as claimed in claim 1, wherein the extension arrangement further comprises a fastener extending through the cover into the screw member.

4. The trimmer razor as claimed in claim 3, wherein one end of the fastener is received within a cavity defined by the screw member via a friction fit.

5. The trimmer razor as claimed in claim 1, wherein the one end of the handle defines a cavity with a threaded inner surface that receives an end of the screw member.

6. The trimmer razor as claimed in claim 1, wherein, upon rotation of the handle in a clockwise direction, the extension arrangement moves the cover to the closed position, and wherein, upon rotation of the handle in a counterclockwise direction, the extension arrangement moves the cover to the open position.

7. The trimmer razor as claimed in claim 1, wherein at least one extension member extends from the cover and is received within the seat to guide movement of the cover relative to the seat.

8. The trimmer razor as claimed in claim 1, wherein the seat and the cover form a planar shaving plane to assist in providing a repeatable shaving angle.

9. The trimmer razor as claimed in claim 1, further comprising at least one magnet provided within the seat to assist in holding a razor blade to the seat.

10. The trimmer razor as claimed in claim 1, further comprising at least one razor blade clamped between the cover and the seat when the cover is in the closed position.

11. The trimmer razor as claimed in claim 10, wherein the base member defines at least one aperture extending through a surface thereof.

12. The trimmer razor as claimed in claim 10, wherein the at least one razor blade is removably provided within the head.

13. The trimmer razor as claimed in claim 1, further comprising at least one protrusion extending from the seat to assist in positioning a razor blade on the seat.

14. The trimmer razor as claimed in claim 13, wherein the at least one protrusion comprises two protrusions that constrain movement of the razor blade in two degrees of freedom on the seat.

* * * * *